US005575624A

United States Patent [19]

Bogage

[11] Patent Number: 5,575,624

[45] Date of Patent: Nov. 19, 1996

[54] METAL CONTOURED BLADE FOR A REVERSIBLE CEILING FAN

[76] Inventor: Gerald I. Bogage, 2245 NW. 72nd Ave., Miami, Fla. 33122

[21] Appl. No.: 601,396

[22] Filed: Feb. 14, 1996

[51] Int. Cl.[6] ..... F04D 29/38

[52] U.S. Cl. ..... 416/242; 416/235

[58] Field of Search ..... 416/235, 242

[56] References Cited

U.S. PATENT DOCUMENTS

| | | | |
|---|---|---|---|
| 1,473,066 | 11/1923 | Wells | 416/235 |
| 1,506,937 | 9/1924 | Miller | 416/242 |
| 1,597,175 | 8/1926 | Boening | 416/235 |
| 1,628,716 | 5/1927 | Fischer | 416/235 |
| 1,818,607 | 8/1931 | Campbell | 416/242 |
| 2,175,609 | 10/1939 | Leeb | 416/235 |
| 2,609,055 | 9/1952 | Monroe . | |
| 3,174,681 | 3/1965 | Monroe | 416/242 |
| 4,892,460 | 1/1990 | Volk . | |

*Primary Examiner*—Edward K. Look
*Assistant Examiner*—Michael S. Lee
*Attorney, Agent, or Firm*—Hoffman, Wasson & Gitler, P.C.

[57] ABSTRACT

A ceiling fan is disclosed as including a reversible motor and a plurality of fan blades, each of which is contoured on both its upper and lower surfaces whereby the air flow is directed in accordance to the direction of rotation of the motor, and wherein the fan is located adjacent to its supporting ceiling.

3 Claims, 1 Drawing Sheet

C
10
12
14
16
3
3
16
23
23
16

18
22
22
16
17

4
16
17
4

17
19
19
16

METAL CONTOURED BLADE FOR A REVERSIBLE CEILING FAN

BACKGROUND OF THE INVENTION

1. Field of the Invention

The present invention is directed to ceiling fans and in particular to a ceiling fan manufactured with metal contoured blades for controlling the direction of the air flow.

2. Description of Prior Art

Many contoured blades are well known in the art of propeller and air blades as used in connection with water craft, air exhaust fans and air circulating floor fans. The prior art is exemplified by U.S. Pat. No. 1,506,934; U.S. Pat. No. 2,609,055; U.S. Pat. No. 3,124,681; and, U.S. Pat. No. 4,892,460. However, none of the above patents discloses the specific metal fan with a special contour as constituted by applicant's invention. By way of example U.S. Pat. No. 4,892,460 discloses a ceiling fan having a fan blade 2 with a trailing edge to which an auxiliary blade 1 is attached; note that the auxiliary blade 1 is merely arcuate and is not contoured like applicant's invention and that this patented fan would not operate in the reverse direction, that the blade 24 is twisted at its free end 27, and that such blade does not utilize a constant contour as used by applicant.

U.S. Pat. No. 3,174,681 discloses a reversible propeller wherein each blade has an S-shaped cross section which is not constant but rather varies from the central hub to the tip thereof.

U.S. Pat. No. 2,609,055 shows a reversible propeller blade having opposite sides which are not S-shaped and which are constructed by two separate sections that are joined together.

U.S. Pat. No. 1,506,937 relates to a fan blade which is twisted along its longitudinal axis and which has a contour that is not constant but rather varies along such axis.

SUMMARY OF THE INVENTION

The present invention is summarized in the combination of a reversible ceiling fan and a contoured unitary blade, which fan is adapted to be secured to a ceiling or the like; wherein each blade is metal and has contoured upper and lower surfaces defining an S-shaped configuration for selectively directing the air flow from the blade upward or downward in accordance with the direction of rotation of the blade.

An object of the present invention is to simplify the construction of a reversible ceiling fan by means of a contoured metal blade to direct air flow according to the direction of rotation of the fan.

This invention has another object in that a reversible ceiling fan is mounted adjacent to the ceiling which may be utilized to facilitate changing the upward direction of the air flow to a generally downward direction.

It is a further object of this invention to reduce the costs and operating expense of a ceiling fan by spacing the fan adjacent to its supporting ceiling thereby utilizing the ceiling to divert upwardly forced air.

DESCRIPTION OF THE PREFERRED EMBODIMENT

Figures 1, 2, 3, 4:
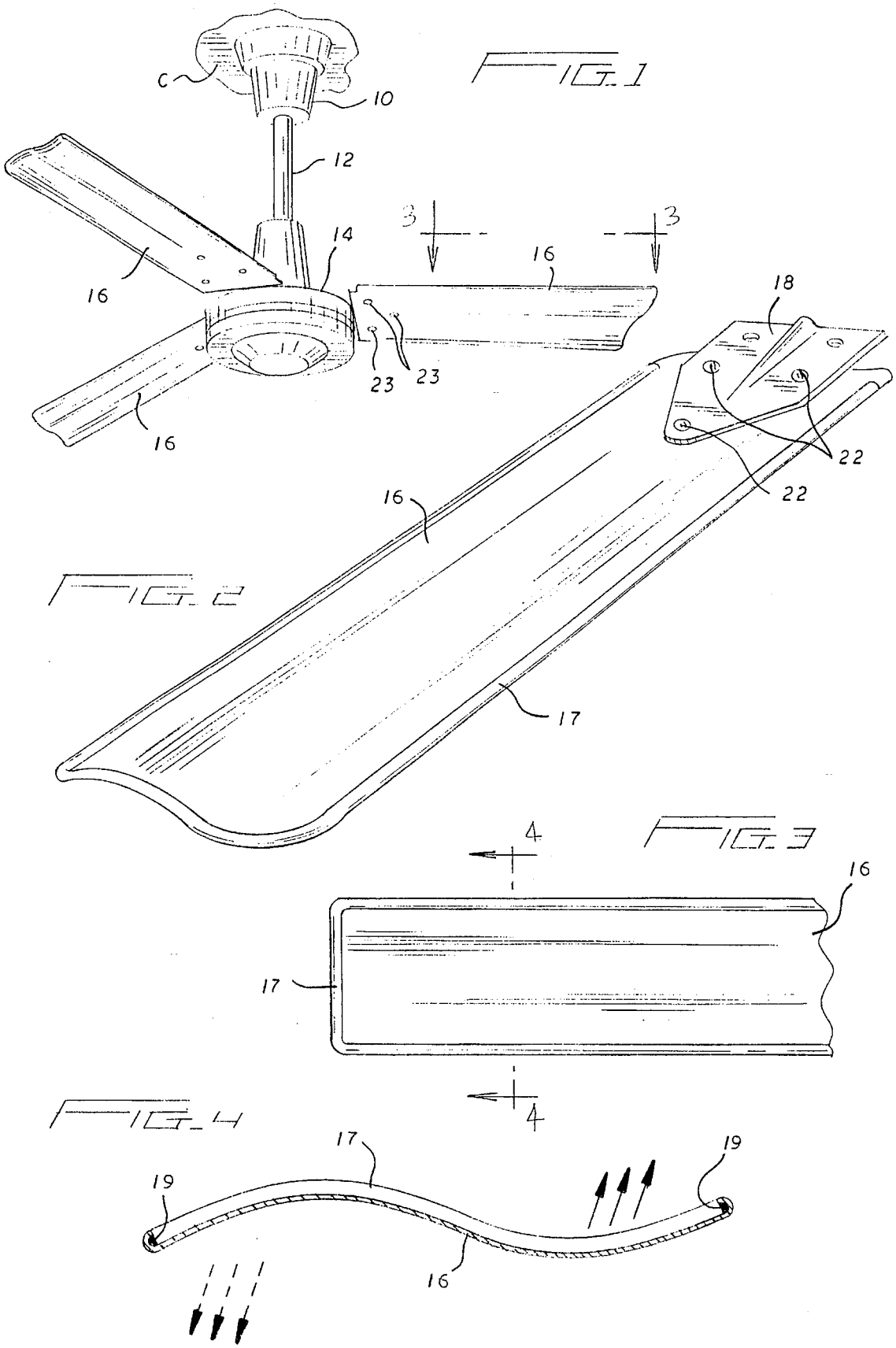
FIG. 1 is a perspective view of an overhead fan suspended from a ceiling and constructed in accordance with the present invention.
FIG. 2 is a perspective view of a contoured metal fan blade shown in FIG. 1.
FIG. 3 is a top plan view of a portion of the blade in FIG. 2.
FIG. 4 is a cross sectional view taken along line 4—4 in FIG. 3.

In this present invention, there is a combination including an overhead ceiling fan and a contoured metal blade therefor. The ceiling fan is not being described in detail, however, a similar ceiling fan is found in U.S. Pat. No. 5,135,365 dated Aug. 4, 1992 and entitled waterproof overhead fan, which patent is incorporated herein by reference in its entirety. While this patent shows a waterproof fan, the present invention is not limited to such a waterproof fan, but rather may be utilized in combination with a variety of ceiling fans.

As is illustrated in FIG. 1, a ceiling fan includes an upper supporting portion 10 secured to a ceiling C by any suitable means (not shown) and a support shaft 12 leading to a lower housing 14 for a conventional electric reversible motor. A plurality of spaced fan blades 16 (three in this instance) are fixed at their inner end to the housing 14 for rotation therewith by means of a mounting plate 18. Two cap bolts (not shown) fasten the plate 18 to the rim of housing 14 while three cap bolts 22 fasten the plate 18 along with three bushings (not shown) to the end portion of blade 16 which is provided with three matching holes 23 (FIG. 2).

As shown in FIGS. 2 and 4, the metal blade 16 is S-shaped in width with the middle of the S defining the longitudinal axis of the blade. As is apparent in FIG. 2, the S-shape presents a contour for the metal blade 16 which is constant for the length of the longitudinal axis of the blade. The width of the blade 16 shows the S-shape to be a flattened curve or an opened ended S.

When the contoured metal blade 16 is rotated in a clockwise direction, the air flow is diverted upward as indicated by the three solid arrows (FIG. 4) while no air flow is directed downward as indicated by the three broken arrows. When the blade 16 is rotated in the opposite direction, i.e., the counterclockwise direction, the air flow is reversed with the upper arrows being broken and the lower arrows being solid. It should be noted that any suitable electric reversible motor may be used and that wiring and control items are conventional products on the market. For example, a control switch may take the form of a 3-way switch having a first off position, a second on position for clockwise rotation and a third on position for counterwise position.

Operation of the contoured fan is accomplished by moving the switch from the first off position to the second on position whereby the fan is rotated in a clockwise direction and the air is moved in a generally upwardly direction (FIG. 4) as would be helpful in large greenhouses and/or poultry farmhouses. Wintertime operation of the contoured fan is effected by moving the switch to the third on position whereby the fan is rotated in a counterclockwise direction and the air is moved generally downwardly (FIG. 4) as would be helpful to exhaust the air through open windows; by closing the windows the air would be diverted from the ceiling downwardly toward the floor.

With the above-described fan, the construction utilizes the ceiling for redirecting the air flow; this simple arrangement removes the expensive and cumbersome features of the prior art devices.

Advantages of the present invention may be realized by the following comparison of prior art fan blades and the operation of the present fan blades. A residential style fan is mounted in an 8 foot ceiling and uses a flat wooden paddle blade that operates in either direction with minimal air flow. A commercial and industrial fan operates in spacious areas with ceiling heights from 12 to 80 feet and requires a contour blade and a large motor to achieve maximum performance.

A standard metal contoured blade achieves air flow in a clockwise rotation but at the same time the back of the blade rolls the air off in the clockwise direction.

The metal blade of the present invention overcomes the above problems in that one-half is designed for forward operation while the other half free wheels. When this rotation is reversed, the free wheel is on the opposite side, thus producing opposite air delivery with minimal drag or resistance.

This new blade serves as a dual purpose product. In effect, instead of manually changing the blade set to up side down for reverse operations, the new blade is two blades in one. It is virtually impossible to change blades when the mounting heights of the fans are 12 to 85 feet in the air. With the new blade, the feature of reversing the air flow is achieved without changing the blade set.

It is noted that ceiling fans are installed in rooms having ceilings of approximately 8 feet in height. The current safety standard permits ceiling fans to be suspended in applications where the height from blade to floor exceeds 7 feet provided the blade thickness is a minimum of 3/16 inch at the forward impact edge. Such safety standard was set upon the thickness of wooden paddle fan blades and virtually eliminated the use of metal blades.

Accordingly, the present invention solves the above problem by designing the edge of the metal blade to duplicate the edge of the wooden paddle, i.e., 3/16 inch. In FIGS. 2–4, the three outer edges of the contoured metal blade 16 are each rolled back to form a 3/16 inch roll. It is recognized that a contoured aerodynamic metal blade has superior air velocity compared to a flat wooden blade design. This unique rolled edge metal blade design permits the metal high velocity blade to be used in low ceiling areas that heretofore were precluded for metal blades.

As is apparent from FIG. 3, the reversing contoured metal blade 16 includes a continuous rolled edge 17 defined by the leading and trailing edges and the end shape therebetween. When the electric motor is reversed, the trailing edge 3/16 inch piece of metal acts as an air brake which increases the drag on the motor and causes the temperature heat rise of the motor. To compensate for this drag, the back side of the rolled edge 17 is shown in FIG. 4 as being filled with filler putty 19 whereby the drag is eliminated.

Inasmuch as the present invention is subject to many variations, modifications and changes in detail, it is intended that all matter contained in the foregoing description or shown on the accompanying drawing shall be interpreted as illustrative and not in a limiting sense.

What is claimed is:

1. A ceiling fan comprising a reversible motor and a plurality of fan blades rotated thereby, supporting means for supporting the fan from a ceiling or the like, each fan blade being a contoured metal blade having an S-shaped configuration with an upper surface on the top of the blade and a lower surface on the bottom of the blade, said upper surface directing air flow upwardly when the fan is rotated in a clockwise direction while simultaneously no air flows downwardly, said lower surface directing air flow downwardly when the fan is rotated in a counterclockwise direction while simultaneously no air flows upwardly, each contoured metal blade having a leading edge and a trailing edge joined by an end edge, a continuous rolled edge is formed on the three edges, and a quantity of filler putty is inserted in the continuous rolled edge to eliminate any drag caused by the rolled edge.

2. A ceiling fan as claimed in claim 1 wherein the rolled edges are integral with said the blade edges and are rolled back therefrom.

3. A ceiling fan as claimed in claim 2 wherein the fan blades are supported from the ceiling so as to be positioned at least 7 feet from an appropriate flooring.

* * * * *